US007634880B2

(12) United States Patent
Sironko et al.

(10) Patent No.: US 7,634,880 B2
(45) Date of Patent: Dec. 22, 2009

(54) FOAM SEAL FRAME CORNER JOINT AND METHOD OF MANUFACTURE

(75) Inventors: Phil Sironko, Tacoma, WA (US); Leslie Kirk Walters, Taylor, MI (US); John W. Carless, Howell, MI (US); John J. Klein, Whitmore Lake, MI (US); Cliff Chiang, Canton, MI (US); Michael Krushlin, Westland, MI (US)

(73) Assignee: Milgard Manufacturing, Inc., Tacoma, WA (US)

( * ) Notice: Subject to any disclaimer, the term of this patent is extended or adjusted under 35 U.S.C. 154(b) by 547 days.

(21) Appl. No.: 11/377,978

(22) Filed: Mar. 17, 2006

(65) Prior Publication Data

US 2007/0234677 A1 Oct. 11, 2007

(51) Int. Cl.
*E06B 3/70* (2006.01)

(52) U.S. Cl. ..... 52/456; 52/455; 49/471; 49/501

(58) Field of Classification Search ..... 52/656.5, 52/656.2, 656.1, 656.9, 309.1, 309.4, 456, 52/455; 49/471, 469, 470, 501, 468
See application file for complete search history.

(56) References Cited

U.S. PATENT DOCUMENTS

| | | | | |
|---|---|---|---|---|
| 2,861,659 | A | 11/1958 | Hagerty et al. | |
| 2,989,788 | A | 6/1961 | Kessler | |
| 3,606,419 | A | 9/1971 | Virkler et al. | |
| 3,782,054 | A | 1/1974 | Goss, Jr. | |
| 3,885,371 | A | 5/1975 | Oakes | |
| 3,949,526 | A | 4/1976 | Sherlock et al. | |
| 3,968,561 | A * | 7/1976 | Oakes et al. | 29/460 |
| 4,192,624 | A | 3/1980 | Bucci | |
| 4,222,209 | A | 9/1980 | Peterson | |
| 4,240,765 | A | 12/1980 | Offterdinger | |
| 4,296,587 | A | 10/1981 | Berdan | |
| 4,336,645 | A | 6/1982 | Bucci | |
| 4,453,855 | A | 6/1984 | Richter et al. | |

(Continued)

FOREIGN PATENT DOCUMENTS

| | | | |
|---|---|---|---|
| DE | 3408995 | A1 | 9/1985 |

(Continued)

*Primary Examiner*—Richard E Chilcot, Jr.
*Assistant Examiner*—Chi Q Nguyen
(74) *Attorney, Agent, or Firm*—Reising, Ethington PC

(57) ABSTRACT

A frame corner joint includes first and second frame rails having hollow interiors of predetermined contours and ends in mitered abutment. A corner key has legs inserted into the mitered ends of the frame rails. End portions of the legs substantially fill the hollow interiors of the frame rails forming a substantially closed cavity within the frame rails and between the end portions of the corner key legs. Solidified resin foam is disposed within this cavity rigidifying the corner joint, while the remainder of the interiors of the frame rails preferably is substantially free of solidified foam. At least one end portion of at least one leg of the corner key preferably has a flexible wall portion to permit escape of foam from within the cavity in the event of excess foam pressure. The hollow interiors of the frame rails preferably are mirror images of each other, and the legs of the corner key, including the end portions of the legs, preferably are mirror images of each other.

7 Claims, 5 Drawing Sheets

U.S. PATENT DOCUMENTS

| | | | | | |
|---|---|---|---|---|---|
| 4,608,802 | A | | 9/1986 | Bayer | |
| 4,651,482 | A | | 3/1987 | Borys | |
| 4,822,205 | A | | 4/1989 | Berdan | |
| 4,841,696 | A | * | 6/1989 | Miller | 52/202 |
| D313,170 | S | | 12/1990 | Nye | |
| 4,987,709 | A | | 1/1991 | Bucci | |
| 5,010,708 | A | | 4/1991 | Evans et al. | |
| 5,048,997 | A | | 9/1991 | Peterson | |
| 5,109,645 | A | | 5/1992 | Bucci | |
| 5,129,975 | A | | 7/1992 | Easterle et al. | |
| 5,154,531 | A | | 10/1992 | Peterson | |
| 5,325,648 | A | * | 7/1994 | Menard | 52/456 |
| 5,921,037 | A | | 7/1999 | Minter | |
| 5,921,051 | A | | 7/1999 | Hope | |
| 5,960,605 | A | | 10/1999 | Hope | |
| 6,047,514 | A | | 4/2000 | Verch | |
| 6,073,412 | A | | 6/2000 | Verch | |
| 6,134,857 | A | | 10/2000 | Hope | |
| 6,164,036 | A | | 12/2000 | Manser | |
| 6,746,175 | B1 | | 6/2004 | Gonnerman et al. | |
| 6,862,859 | B2 | | 3/2005 | Kronenberg | |
| 7,296,388 | B2 | * | 11/2007 | Valentz et al. | 52/200 |
| 2001/0014250 | A1 | | 8/2001 | Plummer et al. | |

FOREIGN PATENT DOCUMENTS

| | | | |
|---|---|---|---|
| EP | 0810344 | A2 | 12/1997 |
| EP | 0825322 | | 2/1998 |
| FR | 2258510 | | 8/1975 |
| FR | 2759111 | | 8/1998 |

* cited by examiner

FOAM SEAL FRAME CORNER JOINT AND METHOD OF MANUFACTURE

The present disclosure relates to corner joints in frames for windows and/or doors for example, and to a method of making such a corner joint.

BACKGROUND AND SUMMARY OF THE DISCLOSURE

A general object of the present disclosure is to provide a frame corner joint that is of light-weight rigid construction. Related objects of the present disclosure are to provide a corner key for making such a corner joint and a method of manufacturing such a corner joint.

The present disclosure embodies a number of aspects that can be implemented separately from or in combination with each other.

A frame corner joint in accordance with one aspect of the present disclosure includes first and second frame rails having hollow interiors of predetermined contours and ends in mitered abutment. A corner key has legs inserted into the mitered ends of the frame rails. End portions of the legs substantially fill the hollow interiors of the frame rails forming a substantially closed cavity within the frame rails and between the end portions of the corner key legs. Solidified resin foam is disposed within this cavity rigidifying the corner joint, while the remainder of the interiors of the frame rails preferably is substantially free of foam. At least one end portion of at least one leg of the corner key preferably has a flexible wall portion to permit escape of foam from within the cavity in the event of excess foam pressure. The hollow interiors of the frame rails preferably are mirror images of each other, and the legs of the corner key, including the end portions of the legs, preferably are mirror images of each other.

A corner key for joining mitered ends of frame rails to form a corner point, in accordance with another aspect of the disclosure, includes a one-piece body having mutually perpendicular legs. The legs are contoured to be secured by friction fit within the hollow interiors of the mitered rail ends and have end portions constructed substantially to fill the hollow rail interiors. At least one leg end portion, and preferably both of the leg end portions, preferably includes at least one flexible wall portion. The legs of the corner key, including the leg end portions, preferably are mirror images of each other.

A method of making a frame corner joint, in accordance with a further aspect of the present disclosure, includes providing first and second frame rails having hollow interiors of predetermined contours, and a corner key having legs with end portions constructed substantially to fill the hollow interiors of the frame rails. The frame rails are assembled over the corner key by inserting the legs into the hollow interiors of the frame rails until mitered ends of the frame rails abut each other, and the opposed end portions of the legs substantially fill the hollow interiors of the frame rails to form a substantially closed continuous cavity between the end portions of the corner key and the interiors of the frame rails. Resin foam is injected into the substantially closed cavity and allowed to cure to form a rigid corner joint. The step of injecting resin foam into the substantially closed cavity preferably is carried out by injecting the foam through aligned openings in at least one of the frame rails and at least one leg of the corner key.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
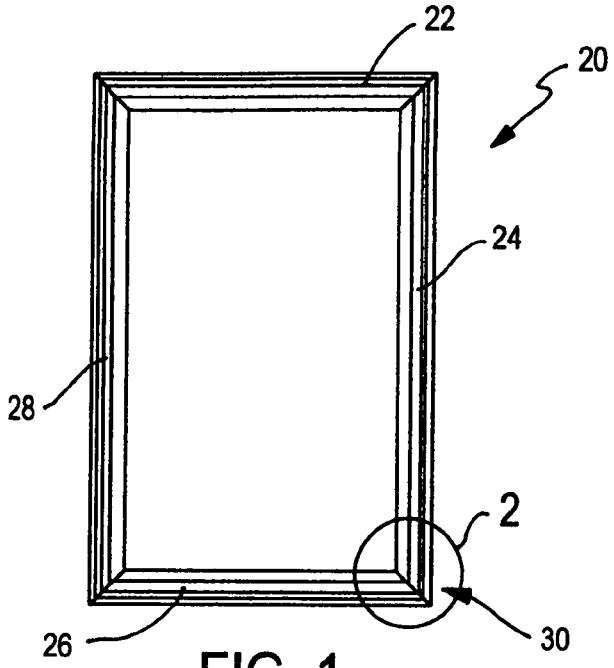
FIG. 1 is a front elevational view of a frame in accordance with one exemplary embodiment of the present disclosure.
Figure 2:
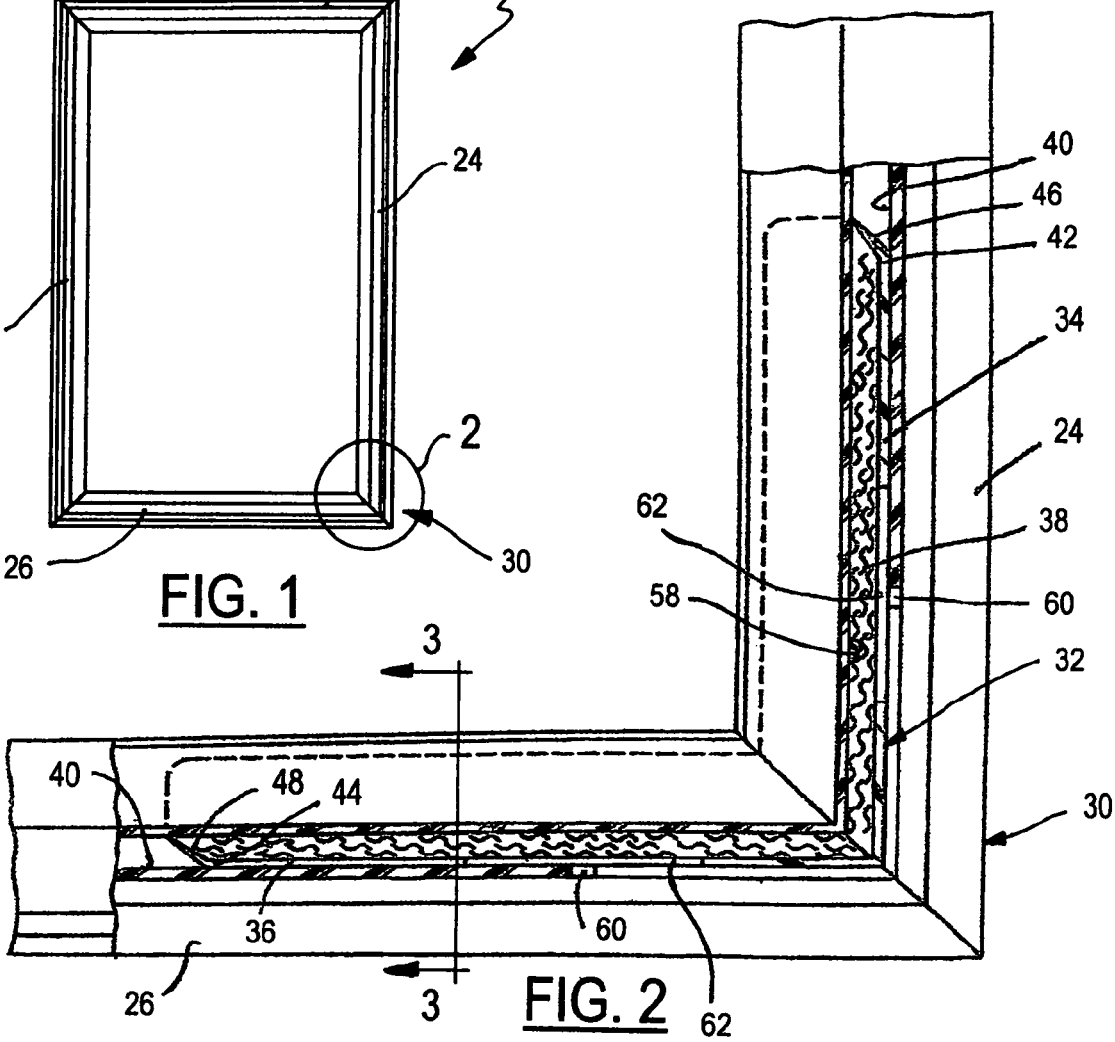
FIG. 2 is a fragmentary partially sectioned view on an enlarged scale of the portion of FIG. 1 within the area 2.
Figure 3:
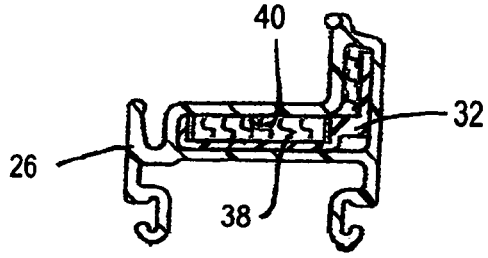
FIG. 3 is a sectional view taken substantially along the line 3-3 in FIG. 2.

FIG. 1 illustrates a frame 20 in accordance with one exemplary embodiment of the present disclosure as being of generally rectangular geometry including opposed end rails 22,26 and opposed side rails 24,28. Rails 24,26 are joined at a mitered corner joint 30 in accordance with one aspect of the present disclosure. The joints at the other corners of frame 20 preferably are identical to point 30 to be described in detail. Frame 20 can be of any suitable geometry such as rectangular (including square) as illustrated, or any other geometry having at least one mitered corner joint 30. Corner joint 30 preferably is a right-angle corner joint, although non-right-angle corner joints could be implemented in accordance with the broadest aspects of the disclosure. Frame rails 22-28 preferably are of identical cross sectional geometry, preferably having identical hollow interiors 40 (FIGS. 2-3). The cross sectional geometry of hollow interior 40 is determined by the desired outside geometry of the frame rails and the desired thickness of the frame rail walls. As best seen in FIG. 3, hollow interiors 40 in this particular example are generally L-shaped in cross section. Hollow interior 40 of rails 24, 26 are mirror images of each other at corner joint 30, and the same preferably is true of the other frame corners. The longitudinal dimensions of interiors 40 preferably are at right angles to each other at each corner joint. Frame rails 22-28 preferably are of pultruded fiber-reinforced resin construction, although other constructions can be employed such as roll-formed aluminum for example.

Figure 6:
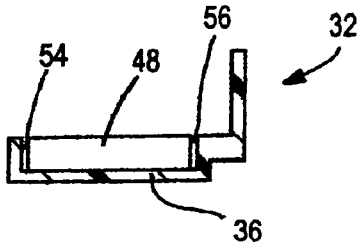
FIG. 6 is a sectional view taken substantially along the line 6-6 in FIG. 5.

Corner joint 30 is illustrated in detail in FIGS. 2-3. In general, corner joint 30 includes a corner key 32 (FIGS. 2-6) and solidified foam 38 in the cavity formed by key 32 within rails 24, 26. Corner key 32 has a pair of legs, preferably mutually perpendicular legs 34, 36. Leg 34 has an end portion 42 that substantially fills hollow interior 40 of rail 24. Likewise, leg 36 has an end portion 44 that substantially fills hollow interior 40 of rail 26. In lateral cross section, as best seen in FIGS. 3 and 6, corner key 32, including legs 34, 36, is contoured in accordance with the hollow interior contour of the rail geometry with which corner key 32 is associated. Different corner keys are constructed for different rail geometries, as illustrated in FIGS. 7-15. End portion 42 of leg 34 preferably includes a flexible wall portion or flap 46, which preferably is outwardly angled with respect to the longitudinal dimension of leg 34. Likewise, end portion 44 of leg 36 preferably includes a flexible wall portion or flap 48, which preferably is outwardly angled with respect to the longitudinal dimension of leg 36. Each flexible wall portion 46, 48 preferably is contiguous with the associated base 50, 52 of legs 34, 36, and is separated from the sidewalls of the legs by laterally spaced gaps 54, 56. Flexible wall portions 46, 48 preferably (although not necessarily) are thinner than the adjacent portions of the respective leg end portions 42, 44. Legs 34, 36, including end portions 42, 44, preferably are mirror images of each other, and at least one flexible wall portion 46, 48 preferably is provided at each leg end portion. (The embodiment of FIGS. 7-9, for example, has three flexible wall portions at the end portion of each leg.) However, as will be described in connection with FIG. 4, the corner key could be provided with only one flexible wall portion at the end portion of one but not the other leg and still function to relieve excess foam pressure in accordance with this aspect of the present disclosure. Corner key 32 preferably is of fiber-reinforced resin or other relatively rigid molded plastic construction.

In the manufacture of corner joint 30, rails 24, 26 are assembled over legs 50, 52 of corner key 32 until the mitered ends of the respective rails are in abutment. The cross sectional geometries of corner key legs 34, 36, including the geometries of respective end portions 42, 44, preferably are such that the respective legs are friction-fit within the hollow interiors 40 of the respective frame rails 24, 26. The end portions 42, 44 of corner key 32, including the preferred flexible wall portions 46, 48, substantially fill the hollow interiors 40 of frame rails 24, 26. (By "substantially fill" it is meant that gaps or spaces between the end portions of the corner key legs and the surrounding interior surfaces of the rails primarily are the result of manufacturing limitations and tolerance variations of the rail interiors and the corner keys.) The end portions of the corner key legs, including the preferred flexible wall portions, thus cooperate with the hollow interiors 40 of rails 24, 26 to form substantially closed interior cavity 58. Cavity 58 is formed by the interior surfaces of hollow interiors 40 and by end portions 42, 44 of corner key 32. Cavity 58 preferably is continuous between the leg end portions, which is to say that there preferably is no divider wall or the like, such as at the abutting ends of rails 24, 26, to divide the cavity into sections. In the preferred right-angle geometry of the corner joint, cavity 58 has mutually perpendicular legs that are mirror images of each other and form a continuous L-shaped cavity.

Foam 38 is then injected into cavity 58 through at least one opening 60 in at least one of the frame rails 24, 26 and through an associated opening 62 in at least one of the corner key legs 34, 36. The opening 60 in one or both frame rails 24, 26 may be preformed in the frame rail, or may be drilled into the frame rail after the frame rails have been assembled to corner key 32. Openings 62 preferably are formed in both legs 34, 36 of corner key 32 so that identical corner keys can be used at all four corners of frame 20 (FIG. 1). Openings 62 preferably are elongated in the direction of the longitudinal dimensions of respective legs 34, 36 to accommodate variations in positioning of opening 60 in rail 24 and/or 26. In a preferred implementation of the disclosure, opening 60 in rail 24 and/or 26 is formed by drilling after assembly of the rails to the corner key. FIG. 2 illustrates openings 60 in both frame rails 24, 26, although only one such opening would be drilled in the preferred implementation of the disclosure because cavity 58 preferably is filled with one shot of foam injection.

Figure 4:
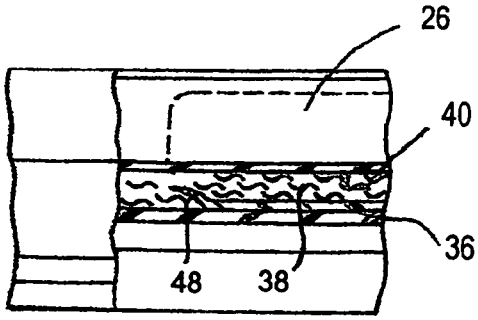
FIG. 4 is a fragmentary partially sectioned view of a portion of FIG. 2 that illustrates operation in accordance with one aspect of the present disclosure.
Figure 5:
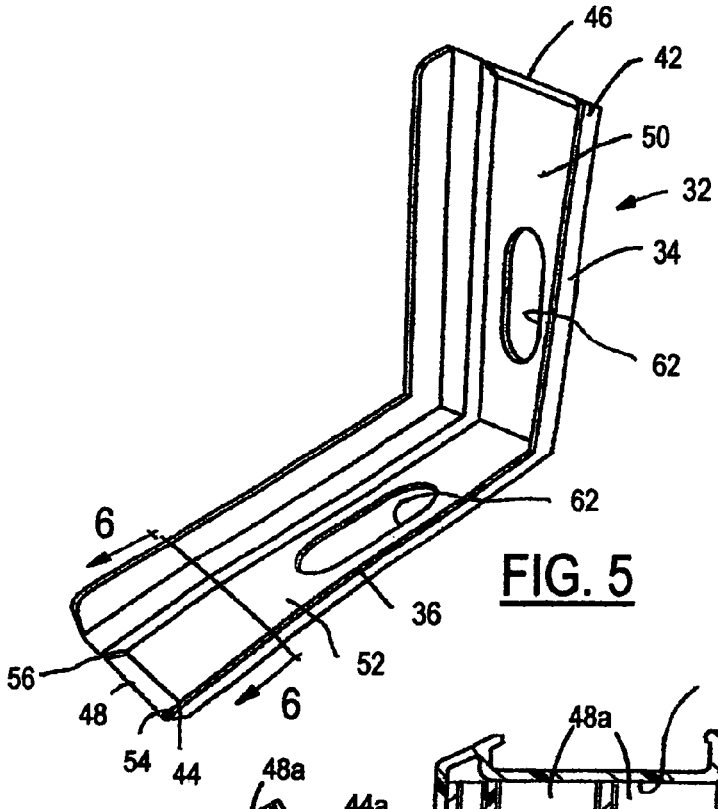
FIG. 5 is a perspective view of a corner key in the embodiment of FIGS. 1-4.

Resin foam in melt phase then is injected into cavity 58 through aligned openings 60, 62. The amount of resin foam injected into the cavity is premeasured to fill the cavity without substantial excess. In the event of injection of excess foam, or in the event of overpressure during curing, the pressure of the foam within cavity 58 flexes one or both flexible wall portions 46,48 outwardly, as illustrated in FIG. 4, so that some foam can escape into the hollow interiors 40 of one or both frame rails 24 and thereby relieve pressure within cavity 58. However, only minimal foam flows out of corner cavity 58 into the interiors of one or both frame rails, which is to say that the hollow interiors 40 of frame rails 24, 26 are substantially free of foam except at the corner joint. The other frame corner joints preferably are formed in the same manner.

FIGS. 7-9, 10-11, 12-13 and 14-15 illustrate respective additional exemplary embodiments of the corner joint before injection of foam and respective exemplary corner keys associated with such corner joints. In each such embodiment, components similar to those discussed in connection with FIGS. 1-6 are indicated by correspondingly identical reference numerals followed by an associated letter suffix.

Figure 7:
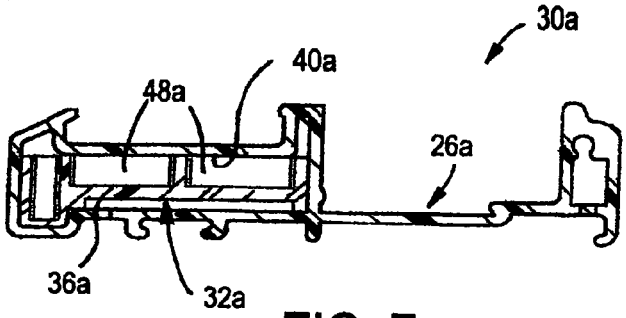
FIG. 7 is a sectional view similar to that of FIG. 3 but illustrating another exemplary embodiment of the present disclosure.
Figure 8:
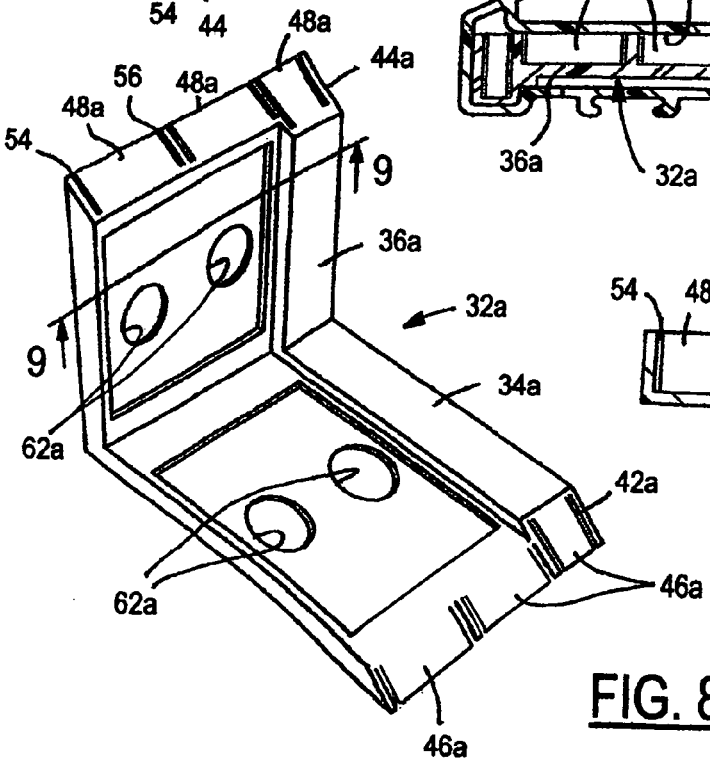
FIG. 8 is a perspective view of the corner key in the embodiment of FIG. 7.
Figure 9:
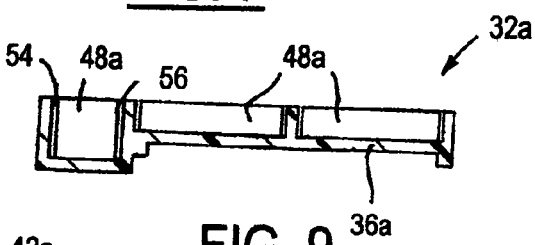
FIG. 9 is a sectional view taken substantially along the line 9-9 in FIG. 8.

FIGS. 7-9 illustrate a corner joint 30*a* including a frame rail 26*a* and a corner key 32*a*. Corner key 32*a* has legs 34*a*, 36*a* with associated end portions 42*a*, 44*a*. At least one end portion, and preferably both end portions, has at least one flexible wall portion 46*a*, 48*a*. In this exemplary embodiment, the elongated generally rectangular geometry of rail interior 40*a* is such that each leg 34*a*, 36*a* preferably has three flexible wall portions 46*a*, 48*a*. Each such flexible wall portion is separated from adjacent relatively rigid sections of the end portions by slots 54, 56, which preferably are laterally spaced from and parallel to each other as in the embodiment of FIGS. 1-6. Each leg 34*a*, 36*a* preferably is provided with at least one through-opening 62*a* for alignment with an associated opening in a frame rail for injection of resin foam in melt phase as previously described. Again, because of the elongated lateral dimension of interior 40*a*, two laterally adjacent openings 62*a* may be provided in each leg. As best seen in FIG. 7, the end portion 42*a* of corner key 38*a* substantially fills the hollow interior 40*a* of frame rail 26*a*.

Figure 11:
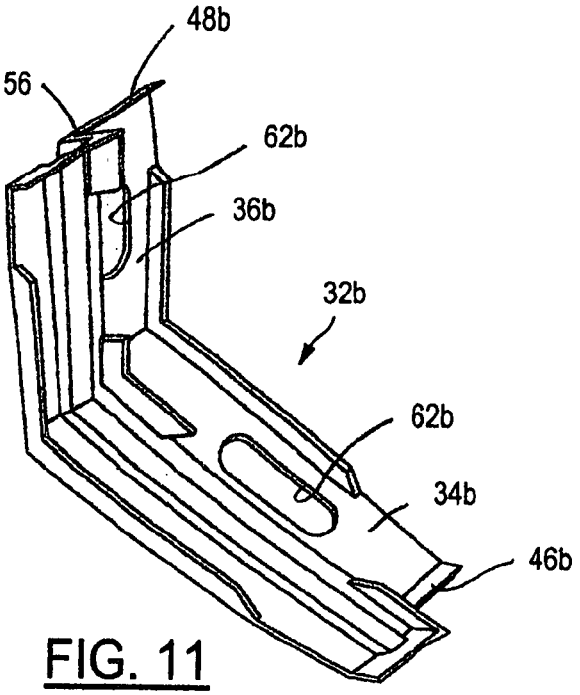
FIG. 11 is a perspective view of the corner key in the embodiment of FIG. 10.
Figure 10:
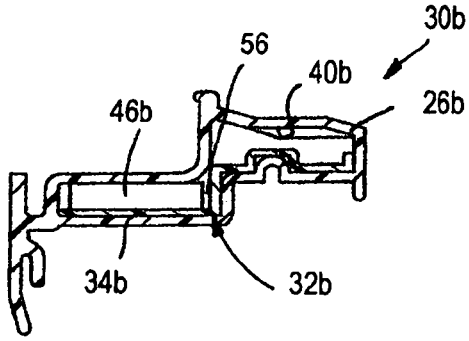
FIG. 10 is a sectional view similar to those of FIGS. 3 and 7 but illustrating another exemplary embodiment of the present disclosure.
Figure 12:
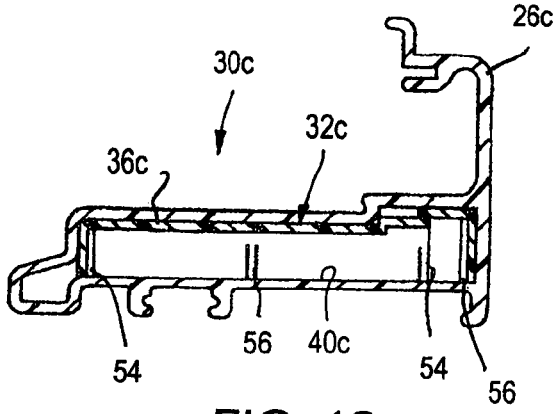
FIG. 12 is a sectional view similar to those of FIGS. 3, 7 and 10 but illustrating another exemplary embodiment of the present disclosure.
Figure 13:
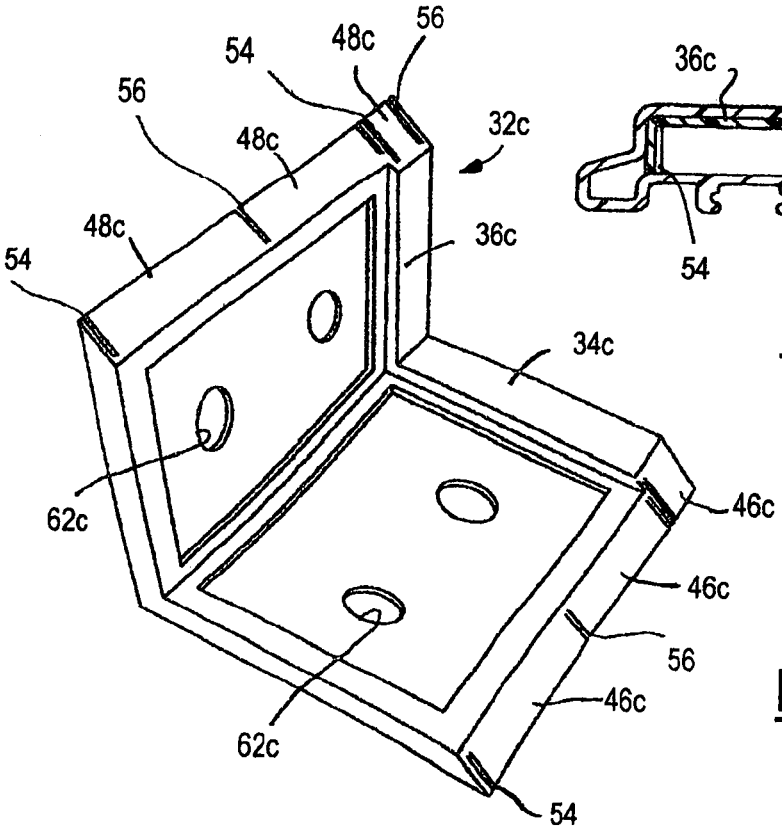
FIG. 13 is a perspective view of the corner key in the embodiment of FIG. 12.

FIGS. 10 and 11 illustrate a frame corner joint 30*b* and an associated corner key 32*b* in accordance with another exemplary embodiment of the present disclosure. Likewise, FIGS. 12 and 13 illustrate a frame corner joint 30*c* and a corner key 32*c* in accordance with a further exemplary embodiment of the present disclosure. The geometries of the hollow rail interiors 40*b*, 40*c* are different from each other in FIGS. 10-13 and from interiors 40, 40*a* previously discussed, and the lateral geometries of the corner key legs correspondingly differ. However, the principles of construction and operation remain the same as previously discussed.

Figure 14:
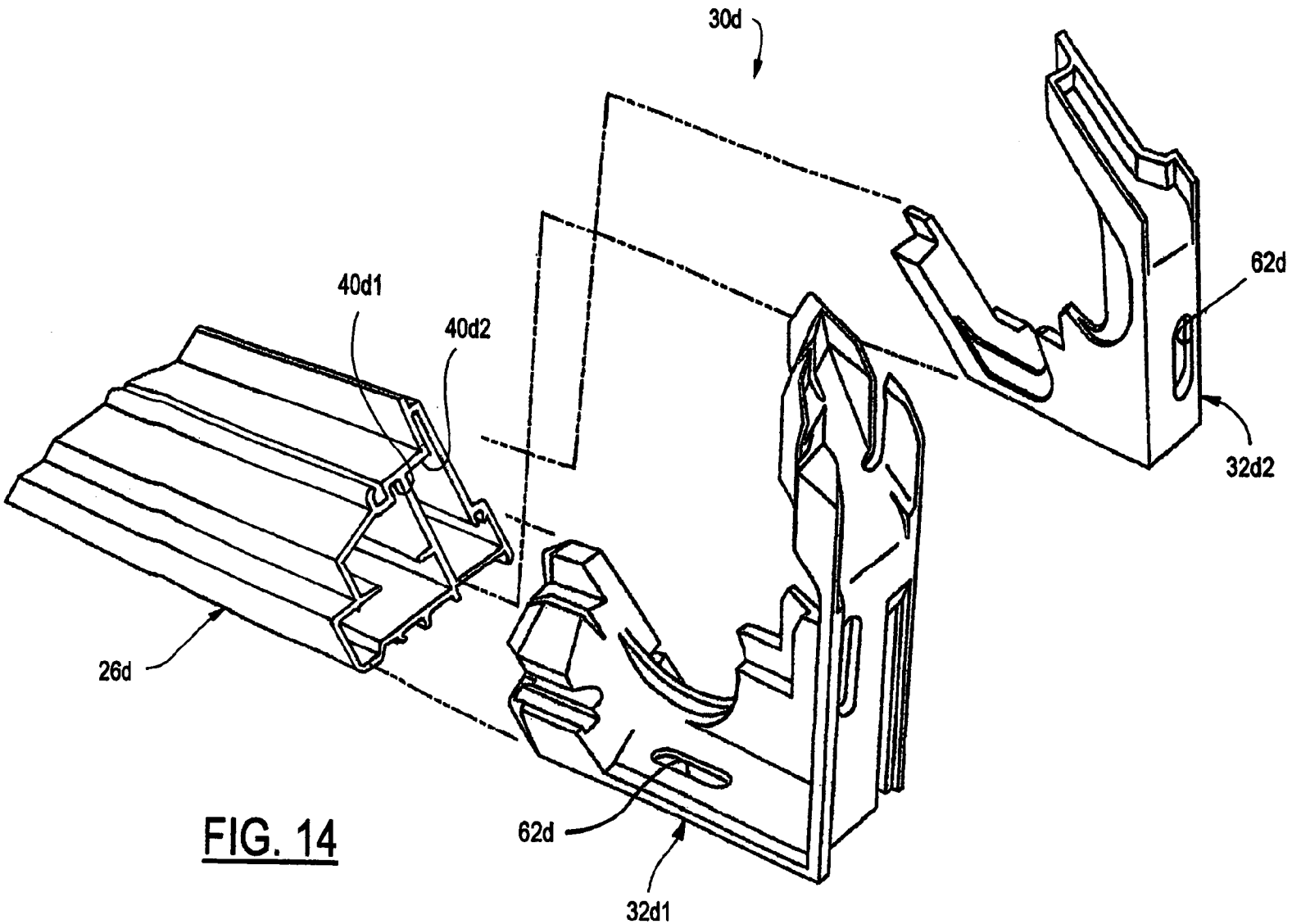
FIG. 14 is an exploded perspective view of a corner joint in accordance with a further exemplary embodiment of the present disclosure.
Figure 15:
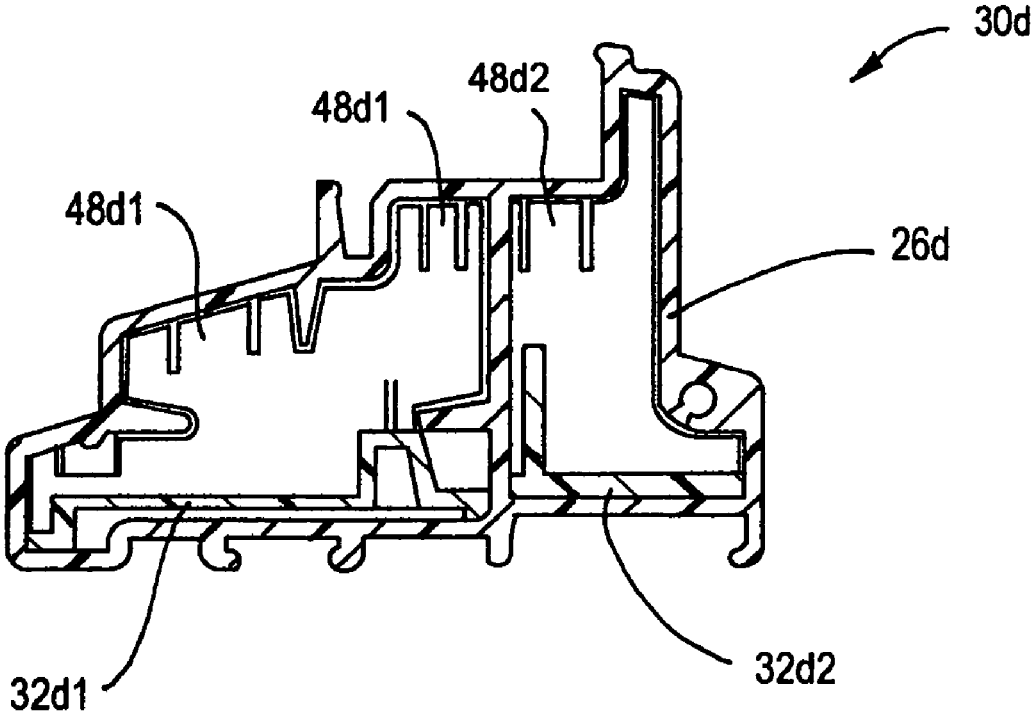
FIG. 15 is a sectional view similar to those of FIGS. 3, 7, 10 and 12 but illustrating the embodiment of FIG. 14.

FIGS. 14-15 illustrate a frame corner joint 30*d* in which frame rail 26*d* has a pair of hollow interiors 40*d*1 and 40*d*2. In frame corner joint 30*d*, there are a pair of corner keys 32*d*1 and 32*d*2 adapted for insertion into hollow interiors 40*d*1 and 40*d*2 respectively. The end portions of the respective legs of the corner keys preferably have flexible wall portions 48*d*1, 48*d*2 to permit escape of foam in the event of overpressure as previously described.

There thus have been disclosed a frame corner joint, a corner key for a frame corner joint and a method of making a frame corner joint, that fully satisfy all of the objects and aims previously set forth. The disclosure has been presented in conjunction with several exemplary embodiments, and a number of additional modifications and variations have been discussed. In each embodiment of the present disclosure, the mitered frame rails abut each other and have hollow interiors that preferably are mirror images of each other. Likewise, in each exemplary embodiment, the legs of the corner key preferably are perpendicular to each other and preferably are mirror images of each other. The corner keys may be of fiber-reinforced resin or any other suitable construction. Polyurethane foam is preferred for rigidifying the corner joint, although other suitable resin foams can be utilized. In each embodiment, the end portions of the corner key legs cooperate with the hollow interiors of the frame rails to form a substantially closed cavity, into which resin foam is injected to rigidify the corner joint. At least one leg end portion of the corner key, and preferably both leg end portions inasmuch as the corner key legs preferably are mirror images of each other, preferably includes a flexible resilient wall portion or flap that is adapted to flex outwardly from the substantially closed cavity to permit egress of excess foam during injection or curing in the event of overpressure within the substantially closed cavity. However, the hollow interiors of the frame rails are substantially free of foam except, of course, at the corner joint. The disclosure is intended to embrace all modifications and variations as fall within the spirit and broad scope of the appended claims.

The invention claimed is:

1. A frame corner joint that includes:

first and second frame rails having hollow interiors of predetermined contours and ends in mitered abutment, a corner key having legs inserted into said mitered ends, said legs having end portions that substantially fill said hollow interiors of predetermined contour so as to form a substantially closed cavity within said rails at said joint, and solidified foam within said cavity rigidifying said joint, wherein at least one of said end portions includes at least one flexible wall portion adapted to flex outwardly from said cavity to permit escape of foam from said cavity into a hollow interior of one of said frame rails in the event of excess foam pressure within said cavity.

2. The frame corner joint set forth in claim 1 wherein each of said end portions includes at least one flexible wall portion to permit escape of foam from said cavity into one of said hollow interiors in the event of excess foam pressure within said cavity.

3. The frame corner joint set forth in claim 1 wherein said legs, including said end portions, are mirror images of each other.

4. The frame corner joint set forth in claim 1 wherein said solidified foam is substantially confined within said cavity and does not substantially extend from said end portions into said hollow interiors of said frame rails.

5. The frame corner joint set forth in claim 1 wherein at least one of said legs has an opening for injection of foam.

6. A frame corner joint that includes:

first and second frame rails having hollow interiors that are mirror images of each other and mitered ends in abutment, a corner key having mutually perpendicular legs inserted into said mitered ends, said legs being mirror images of each other and having respective end portions that substantially fill said hollow interiors of said frame rails forming a substantially closed continuous cavity within said rails bounded by said rail corner key, including said end portions, and interior surfaces of said rails, and solidified foam within said cavity rigidifying said corner joint, said solidified foam being substantially confined to said cavity between said end portions of said legs and not substantially extending from said end portions into said hollow interiors of said frame rails, wherein at least one of said end portions includes at least one flexible wall portion adapted to flex outwardly from said cavity to permit escape of foam from said cavity into a hollow interior of one of said frame rails in the event of excess foam pressure within said cavity.

7. The frame corner joint set forth in claim 6 wherein each of said end portions includes at least one flexible wall portion to permit escape of foam from said cavity into one of said hollow interiors in the event of excess foam pressure within said cavity.

* * * * *